United States Patent [19]

Bertolacini et al.

[11] 4,211,634

[45] Jul. 8, 1980

[54] TWO-CATALYST HYDROCRACKING PROCESS

[75] Inventors: Ralph J. Bertolacini, Chesterton, Ind.; Albert P. Yu, Taipai, Taiwan

[73] Assignee: Standard Oil Company (Indiana), Chicago, Ill.

[21] Appl. No.: 960,237

[22] Filed: Nov. 13, 1978

[51] Int. Cl.[2] ..... C10G 13/04; C10G 37/02

[52] U.S. Cl. ..... 208/59; 208/111

[58] Field of Search ..... 208/59, 111

[56] References Cited

U.S. PATENT DOCUMENTS

| | | | |
|---|---|---|---|
| 3,536,605 | 10/1970 | Kittrell | 208/59 |
| 4,001,106 | 1/1977 | Plank et al. | 208/59 |

*Primary Examiner*—Herbert Levine

*Attorney, Agent, or Firm*—James L. Wilson; Arthur G. Gilkes; William T. McClain

[57] ABSTRACT

The process comprises contacting a hydrocarbon feedstock containing a substantial amount of organic nitrogen-containing compounds in a first reaction zone under hydrocracking conditions and in the presence of hydrogen with a first catalyst comprising nickel and molybdenum or nickel and tungsten, their oxides, and/or their sulfides on a co-catalytic acidic cracking support comprising ultrastable, large-pore crystalline alumino-silicate material and a silica-alumina matrix to produce a first hydrocracked effluent and contacting said first hydrocracked effluent in a second reaction zone under hydrocracking conditions and in the presence of hydrogen with a second catalyst comprising cobalt and molybdenum, their oxides, and/or their sulfides on a co-catalytic acidic cracking support comprising ultrastable, large-pore crystalline aluminosilicate material and a silica-alumina matrix to produce a second hydrocracked effluent. Preferably, the first catalyst comprises nickel and tungsten deposed on the co-catalytic acidic cracking support.

In one embodiment of the process, the second catalyst is a catalyst that has been deactivated and then regenerated prior to its use in the process.

45 Claims, 1 Drawing Figure

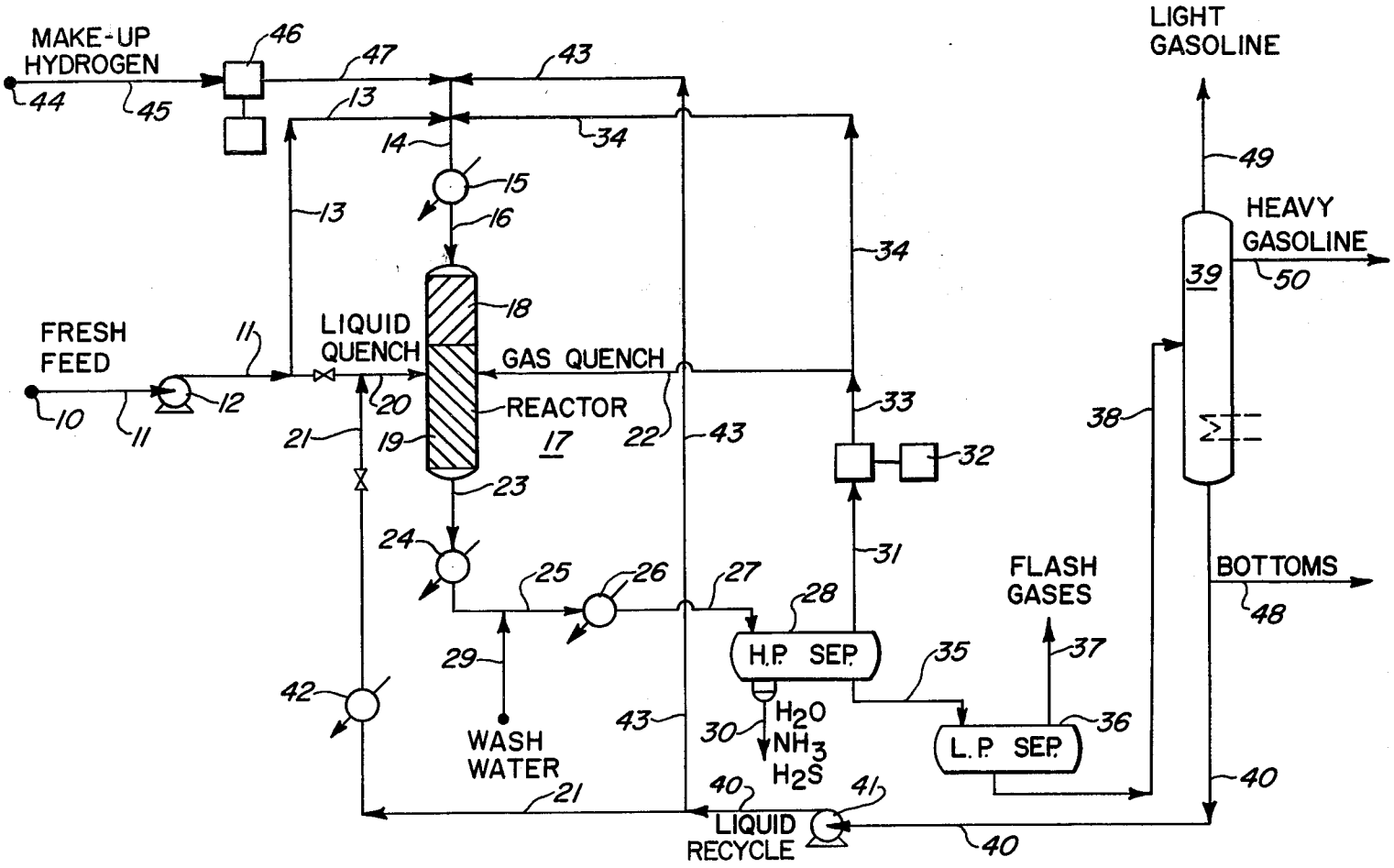
LIGHT GASOLINE
HEAVY GASOLINE
BOTTOMS
FLASH GASES
L.P. SEP.
H.P. SEP.
$H_2O$
$NH_3$
$H_2S$
LIQUID RECYCLE
WASH WATER
GAS QUENCH
REACTOR
LIQUID QUENCH
FRESH FEED
MAKE-UP HYDROGEN

TWO-CATALYST HYDROCRACKING PROCESS

BACKGROUND OF THE INVENTION

The invention pertains to a process for treating a mineral oil having a substantially large nitrogen content during which process at least some hydrocarbon molecules of the mineral oil are chemically altered to form a mineral oil having different properties. More particularly, the invention pertains to a process for hydrocracking hydrocarbon feedstocks containing a large amount of organic nitrogen compounds, which process employs two catalysts.

It is well known that a hydrocracking process may employ a catalyst containing a zeolitic molecular sieve component. In U.S. Pat. No. 3,159,564, Kelley, et al., disclose a hydrofining-hydrocracking process wherein the catalyst employed in the hydrocracking step of the process can contain partially dehydrated, zeolitic, crystalline molecular sieves, e.g., of the "X" or "Y" crystal types. In U.S. Pat. Nos. 3,894,930 and 4,054,539, Hensley discloses a hydrocracking process employing a catalyst comprising a hydrogenation component comprising a Group VI metal, preferably molybdenum, and a Group VIII metal, preferably cobalt, on a co-catalytic acidic cracking component comprising an ultrastable, large-pore crystalline aluminosilicate material and a silica-alumina cracking catalyst.

In U.S. Pat. No. 3,536,605, Kittrell discloses a hydrofining-hydrocracking process which comprises contacting a hydrocarbon feed containing substantial amounts of organic nitrogen with a catalyst comprising a gel matrix comprising silica and alumina and nickel and/or cobalt and molybdenum and/or tungsten and a crystalline zeolitic molecular sieve having a silica-to-alumina ratio above about 2.15, a unit cell size below about 24.65 Angstroms (Å), and a sodium content below about 3 wt.%. Kittrell also discloses that the effluent from the reaction zone of the process may be hydrocracked in a second reaction zone in the presence of hydrogen and a hydrocracking catalyst at hydrocracking conditions.

In U.S. Pat. No. 3,558,471, Kittrell discloses a two-catalyt process wherein the hydrocarbon feedstock is first hydrotreated in the presence of a catalyst comprising a silica-alumina gel matrix containing nickel or cobalt, or both, and molybdenum or tungsten, or both, and a crystalline zeolitic molecular sieve substantially in the ammonia or hydrogen form, substantially free of any catalytic loading metal or metals, the sieve further having a silica-to-alumina ratio above about 2.15, a unit cell size below about 24.65 Å, and a sodium content below about 3 wt.%, calculated as $Na_2O$, to produce a first effluent and contacting the first effluent in a second reaction zone in the presence of a hydrocracking catalyst. The catalyst in the second reaction zone may be the same catalyst as is used in the first reaction zone or it may be a conventional hydrocracking catalyst.

Buchmann, et al., in U.S. Pat. No. 3,788,974, disclose a two-catalyst hydrocracking process wherein a hydrocarbon oil feedstock containing from about 0.01 to 0.5 wt.% nitrogen compounds is contacted in a first hydrocracking zone with a crystalline aluminosilicate zeolite catalyst having hydrogen cations in at least a portion of its exchangeable cationic sites, the zeolite having uniform pore diameters, a crystal structure of faujasite, and a silica-to-alumina mole ratio greater than 3, and containing less than 2 wt.% sodium, the catalyst having associated therewith a hydrogenation component comprising nickel and tungsten, to provide an effluent which is contacted in a second separate hydrocracking zone with a hydrocracking catalyst. The catalyst in the first zone may have a silica-alumina binder, a content of 20% binder being shown in one of the examples, and the second hydrocracking catalyst can be the same as the first catalyst. The catalyst that is employed in the second stage can consist of any desired combination of a refractory cracking base with a suitable hydrogenation component. Suitable cracking bases include, for example, mixtures of two or more difficultly reducible oxides, such as silica-alumina, silica-magnesia, silica-zirconia, acid-treated clays, and the like. The preferred cracking bases comprise partially dehydrated zeolitic X- or Y- type crystalline molecular sieves.

Jaffe, in U.S. Pat. No. 3,536,604, discloses a hydrofining-hydrocracking process wherein a feed containing 300 to 10,000 ppm organic nitrogen is contacted with a hydrofining catalyst at a liquid hourly space velocity (LHSV) of 0.1 to 5 to reduce the organic nitrogen content to a level of 10 ppm to 200 ppm and a substantial portion of the resulting hydrofined hydrocarbon stream is contacted subsequently with a second catalyst comprising a gel matrix comprising at least 15 wt.% silica, alumina, nickel and/or cobalt, molybdenum and/or tungsten, and a crystalline zeolitic molecular sieve substantially in the ammonia or hydrogen form, substantially free of any loading metal, the second catalyst having an average pore diameter that is less than 100 Å and a surface area that is greater than 200 $m^2$/gm. The hydrofining catalyst comprises a Group VI metal, a Group VIII metal, and a support selected from alumina and silica-alumina.

In U.S. Pat. No. 3,535,225, Jaffe discloses a two-catalyst hydrocracking process in which the hydrocarbon feedstock is contacted with a first catalyst comprising a hydrogenating component selected from the group consisting of Group VI metals and compounds thereof and Group VIII metals and compounds thereof and a component selected from the group consisting of alumina and silica-alumina and subsequently with a second catalyst, which second catalyst consists essentially of a gel matrix consisting essentially of a gel selected from silica-alumina, silica-alumina-titania, and silica-alumina-zirconia, at least one hydrogenating component selected from Group VIII metals and compounds thereof, and a crystalline zeolitic molecular sieve substantially in the ammonia or hydrogen form and substantially free of any loading metal or metals.

None of the above patents discloses a two-catalyst hydrocracking process which employs specifically as a first catalyst a catalyst comprising a specific hydrogenation component comprising nickel and molybdenum or tungsten and as the second catalyst a catalyst comprising a specific hydrogenation component comprising cobalt and molybdenum, each of the catalysts also comprising a co-catalytic acidic cracking component comprising an ultrastable, large-pore crystalline aluminosilicate material dispersed in and suspended throughout a silica-alumina matrix. Such a two-catalyst hydrocracking process is disclosed hereinafter.

SUMMARY OF THE INVENTION

Broadly, according to the present invention, there is provided a process for the hydrocracking of a hydrocarbon stream boiling above a temperature of about 300° F. (149° C.) and containing a substantial amount of organic nitrogen-containing compounds, which process comprises: contacting said stream in a first reaction zone under hydrocracking conditions and in the presence of hydrogen with a first catalyst comprising a hydrogenation component comprising nickel and molybdenum or nickel and tungsten and a co-catalytic acidic cracking support comprising an ultrastable, large-pore crystalline aluminosilicate material suspended in and distributed throughout a matrix of silica-alumina to provide a first hydrocracked effluent, said hydrogenation component of said first catalyst being present in the elemental form, as oxides, as sulfides, or mixtures thereof; contacting said first hydrocracked effluent in a second reaction zone under hydrocracking conditions and in the presence of hydrogen with a second catalyst comprising a hydrogenation component comprising cobalt and molybdenum and a co-catalytic acidic cracking support comprising an ultrastable, large-pore crystalline aluminosilicate material suspended in and distributed throughout a matrix of silica-alumina to provide a second hydrocracked effluent, said hydrogenation component of said second catalyst being present in the elemental form, as oxides, as sulfides, or mixtures thereof; and recovering useful products from said second hydrocracked effluent.

Operating conditions in either the first reaction zone or the second reaction zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 standard cubic feet of hydrogen per barrel of feed [SCFB] (890 $m^3/m^3$) to about 20,000 SCFB (3,560 $m^3/m^3$), and a liquid hourly space velocity (LHSV) of about 0.5 volume of hydrocarbon per hour per volume of catalyst to about 5 volumes of hydrocarbon per hour per volume of catalyst. These standard volumes are measured at a temperature of 60° F. (15.6° C.) and a pressure of 14.7 psia (101.3 kPa).

The second catalyst can be a catalyst that has been deactivated and then regenerated prior to its use in said process.

The preferred hydrogenation component of the first catalyst comprises nickel and tungsten.

Suitably, the first catalyst makes up about 10 wt.% to about 50 wt.% of the total catalyst employed in the process. Advantageously, the first catalyst is about 35 wt.% of the total catalyst that is employed in the process of the present invention.

BRIEF DESCRIPTION OF THE DRAWING

The accompanying FIGURE of a simplified schematic flow diagram of a preferred embodiment of the process of the present invention.

DESCRIPTION AND PREFERRED EMBODIMENTS

Broadly, according to the present invention, there is provided a process for the hydrocracking of a hydrocarbon stream boiling above a temperature of about 300° F. (149° C.) and containing a substantial amount of organic nitrogen-containing compounds, which process comprises: contacting said stream in a first reaction zone under hydrocracking conditions and in the presence of hydrogen with a first catalyst comprising a hydrogenation component comprising nickel and molybdenum or nickel and tungsten and a co-catalytic acidic cracking support comprising an ultrastable, large-pore crystalline aluminosilicate material suspended in and distributed throughout a matrix of silica-alumina to provide a first hydrocracked effluent, said hydrogenation component of said first catalyst being present in the elemental form, as oxides, as sulfides, or mixtures thereof; contacting said first hydrocracked effluent in a second reaction zone under hydrocracking conditions and in the presence of hydrogen with a second catalyst comprising a hydrogenation component comprising cobalt and molybdenum and a co-catalytic acidic cracking support comprising an ultrastable, large-pore crystalline aluminosilicate material suspended in and distributed throughout a matrix of silica-alumina to provide a second hydrocracked effluent, said hydrogenation component of said second catalyst being present in the elemental form, as oxides, as sulfides, or mixtures thereof; and recovering useful products from said second hydrocracked effluent.

The hydrocarbon feedstock that may be treated by the process of the present invention boils at a temperature that is above 300° F. (149° C.). It can boil suitably in the range between about 350° F. (177° C.) and about 1,000° F. (538° C.). The feedstock may contain a substantial amount of nitrogen in the form of organic nitrogen compounds. By a substantial amount is meant a nitrogen content of at least 10 ppm nitrogen or an organic nitrogen content that will provide at least 10 ppm nitrogen. Examples of hydrocarbon streams that can be treated by the process of the present invention are light virgin gas oils, heavy virgin gas oils, light catalytic cycle oils, heavy catalytic cycle oils, light vacuum gas oils, and mixtures thereof.

The feed may be pretreated to remove compounds of sulfur and nitrogen. However, the process of the present invention is so designed that a feedstock need not be pretreated to remove the sulfur and nitrogen contaminants. The feed may have a significant sulfur content, ranging from about 0.1 wt.% to about 3 wt.%, or higher, and nitrogen may be present in an amount greater than 500 ppm.

Preferably, the hydrocarbon stream to be treated by the process of the present invention should contain a substantial amount of cyclic hydrocarbons, i.e., aromatic and/or naphthenic hydrocarbons. Advantageously, the feed may contain at least about 35 wt.% to about 40 wt.% aromatics and/or naphthenes.

Typically, the feedstock is mixed with a hydrogen-affording gas, pre-heated to the hydrocracking temperature, and then transferred to one or more hydrocracking reactors. Advantageously, the feed is substantially completely vaporized before being introduced into the reactor system. For example, it is preferred that all of the hydrocarbon feed be vaporized before passing through more than about 20 vol.% of the catalyst in the reactor. In some instances, the feed can be in a mixed vapor-liquid phase. The temperature, pressure, recycle gas rate, and the like, may be adjusted for the particular feedstock in order to achieve the desired degree of vaporization.

The hydrocarbon feedstock is contacted in the hydrocracking reaction zone with the hereinafter-described first hydrocracking catalyst in the presence of hydrogen-affording gas. Hydrogen is consumed in the hydrocracking process and an excess of hydrogen is maintained in the reaction zone. Advantageously, a hydrogen-to-oil ratio of at least 5,000 SCFB (890 $m^3/m^3$) is employed; however, the hydrogen-to-oil ratio can range up to 20,000 SCFB (3,560 $m^3/m^3$). Preferably, a hydrogen-to-oil ratio between about 8,000 SCFB (1,424 $m^3/m^3$) and 15,000 SCFB (2,670 $m^3/m^3$) is used. These standard volumes are measured at a temperature of 60° F. (15.6° C.) and a pressure of 14.7 psia (101.3 kPa). A high hydrogen partial pressure is desirable, since it tends to prolong catalyst activity maintenance.

The hydrocracking reaction zone is operated under conditions of elevated temperature and pressure. The average catalyst bed temperature is about, 550° F. (288° C.) to about 850° F. (454° C.), and preferably a temperature between about 650° F. (343° C.) and about 800° F. (427° C.) is maintained. Since either catalyst of the present invention has a high initial activity which declines rapidly before leveling out during a run, it may be advantageous to come onstream initially at a temperature between about 500° F. (260° C.) and about 600° F. (316° C.), when using fresh catalyst, and then raise the temperature to the range suggested hereinabove after the initial catalyst activity decline has occurred. The total hydrocracking pressure is maintained within the range of about 5 psig (134 kPa) to about 3,000 psig (20,790 kPa). Typically, the LHSV is about 0.5 volume of hydrocarbon per hour per volume of catalyst to about 5 volumes of hydrocarbon per hour per volume of catalyst; preferably, the LHSV is between about 1 volume of hydrocarbon per hour per volume of catalyst and about 3 volumes of hydrocarbon per hour per volume of catalyst. An optimum LHSV is 1 to 2.

As is discussed hereinafter, two catalysts are employed in the process of the present invention. The operating conditions that are employed with each of the two catalysts can be the same; consequently, the conditions employed with each catalyst would fall within the ranges of values mentioned in the above paragraphs.

Each of the two catalysts that are employed in the process of the present invention comprises a hydrogenation component deposed upon a co-catalytic acidic cracking support comprising an ultrastable, large-pore crystalline aluminosilicate material suspended in and distributed throughout a porous matrix of silica-alumina. The hydrogenation component of the first catalyst comprises nickel and molybdenum or nickel and tungsten, while the hydrogenation component of the second catalyst comprises cobalt and molybdenum. The hydrogenation component of either catalyst is present in the elemental form, as oxides, as sulfides, or mixtures thereof. For the first catalyst, the nickel is present in an amount within the range of about 1 wt.% to about 10 wt.%, based upon the weight of the catalyst and calculated as NiO, and either the molybdenum or tungsten is present in an amount within the range of about 4 wt.% to about 25 wt.%, based upon the weight of the catalyst and calculated as the trioxide of the metal. In the case of the second catalyst, the cobalt is present in an amount within the range of about 1 wt.% to about 10 wt.%, based upon the weight of the catalyst and calculated as CoO, and the molybdenum is present in an amount within the range of about 4 wt.% to about 25 wt.%, based upon the weight of the catalyst and calculated as $MoO_3$.

The co-catalytic acidic cracking support comprises an ultrastable, large-pore crystalline aluminosilicate material and a silica-alumina material. The crystalline alumino-silicate material is suspended in and distributed throughout the matrix of the silica-alumina. The support can comprise up to 90 wt.% aluminosilicate material. Preferably, the co-catalytic acidic cracking support comprises about 5 wt.% to about 55 wt.% ultrastable, large-pore crystalline aluminosilicate material. The silica-alumina material can be either a low-alumina or a high-alumina silica-alumina cracking catalyst. A low-alumina silica-alumina contains from about 5 wt.% to about 20 wt.% alumina, while a high-alumina silica-alumina contains from about 20 wt.% to about 40 wt.% alumina.

Certain naturally-occurring and synthetic crystalline aluminosilicate materials, such as faujasite, mordenite, X-type, and Y-type aluminosilicate materials, are commercially available and are effective cracking components for hydrocarbon conversion catalysts. These aluminosilicate materials may be characterized and adequately defined by their X-ray diffraction patterns and compositions. Characteristics of such aluminosilicate materials and methods for preparing them have been presented in the chemical art. In general, their structure is composed of a network of relatively small cavities, which are interconnected by numerous pores which are smaller than the cavities. These pores have an essentially uniform diameter at their narrowest cross section. Basically, the crystal structure is a fixed three-dimensional and ionic network of silica and alumina tetrahedra. These tetrahedra are linked to each other by the sharing of each of their oxygen atoms. Cations are included in the cavities in the crystal structure to balance the electro-valence of the tetrahedra. Examples of such cations are metal ions, ammonium ions, and hydrogen ions. One cation may be exchanged either entirely or partially for another by means of techniques which are well known to those skilled in the art.

There is now available an ultrastable, large-pore crystalline aluminosilicate material. This ultrastable, large-pore crystalline aluminosilicate material, sometimes hereinafter referred to as "ultrastable aluminosilicate material", is the aluminosilicate material that is employed in the catalytic compositions that are used in the process of the present invention.

Ultrastable, large-pore crystalline aluminosilicate material is characterized by an apparent composition which comprises more than 7 moles of silica per mole of alumina in its framework.

The ultrastable aluminosilicate material, which is derived from faujasitic materials, is a large-pore material. By large-pore material is meant a material that has pores which are sufficiently large to permit the passage thereinto of benzene molecules and larger molecules, and the passage therefrom of reaction products. It is preferred to employ a large-pore crystalline aluminosilicate material having a pore size within the range of about 8 Å (0.8 nm) to about 20 Å (2 nm) in catalysts that are employed in petroleum hydrocarbon conversion processes. The ultrastable aluminosilicate material of the catalysts of the present invention possesses such a pore size.

An example of the ultrastable, large-pore crystalline aluminosilicate material that may be employed in the catalyst of this invention is Z-14US Zeolite. Several types of Z-14US Zeolites are considered in U.S. Pat. Nos. 3,293,192 and 3,449,070. An example of a typical X-ray diffraction pattern, along with the description of the method of measurement, is presented in U.S. Pat. No. 3,293,192.

The ultrastable aluminosilicate material is quite stable to exposure to elevated temperatures. This stability to elevated temperatures is discussed in U.S. Pat. Nos. 3,293,192 and 3,449,070 and can be demonstrated by a surface area measurement after calcination at 1,725° F. (941° C.). For example, after a 2-hour calcination at 1,725° F. (941° C.), a surface area that is greater than 150 square meters per gram ($m^2$/gm) is retained. Moreover, its stability has been demonstrated by a surface area measurement after a steam treatment with an atmosphere of 25% steam at a temperature of 1,525° F. (830° C.) for 16 hours. As shown in U.S. Pat. No. 3,293,192, examples of the ultrastable aluminosilicate material Z-14US Zeolite have a surface area after this steam treatment that is greater than 200 $m^2$/gm.

The ultrastable aluminosilicate material exhibits extremely good stability towards wetting, which is defined as that ability of a particular aluminosilicate material to retain surface area or nitrogen-adsorption capacity after contact with water or water vapor. Ultrastable, large-pore crystalline aluminosilicate material containing about 2% sodium has exhibited a loss in nitrogen-adsorption capacity that is less than 2% per wetting.

While the aluminosilicate components of the catalytic compositions of the present invention exhibit extremely good stability toward wetting, there is no suggestion that the catalytic composition itself is possessed of such stability and that it will perform satisfactorily in the presence of large amounts of steam for prolonged periods of time. Abbreviated tests suggest that the catalyst will deteriorate in the prolonged presence of substantial amounts of water.

The cubic unit cell dimension of the ultrastable, large-pore crystalline aluminosilicate material is within the range of about 24.20 Å (2.42 nm) to about 24.55 Å (2.46 nm). This range of values is below those values shown in the prior art for X-type, Y-type, hydrogen-form, and decationized faujasitic aluminosilicates.

The infrared spectra of some dry ultrastable, large-pore crystalline aluminosilicate material shows a prominent band near 3700 $cm^{-1}$ (3695±5 $cm^{-1}$), a band near 3750 $cm^{-1}$ (3745±5 $cm^{-1}$), and a band near 3625 $cm^{-1}$ (±10 $cm^{-1}$). An ultrastable aluminosilicate material characterized by these infrared bands is a preferred type of ultrastable, large-pore crystalline aluminosilicate material. The band near 3750 $cm^{-1}$ is typically seen in the spectra of all synthetic faujasites. The band near 3625 $cm^{-1}$ is usually less intense and varies more in apparent frequency and intensity with different levels of hydration. The band near 3700 $cm^{-1}$ is usually more intense than the 3750 $cm^{-1}$ band. This band near 3700 $cm^{-1}$ is particularly prominent in the spectra of the soda form of the preferred type of ultrastable aluminosilicate material, which contains about 2 to 3 wt.% sodium.

Ultrastable, large-pore crystalline aluminosilicate material that is to be used in the catalysts of the process of the present invention should have an alkali metal content that is less than 1 wt.%, preferably less than 1 wt.%, calculated as the oxide.

Ultrastable, large-pore crystalline aluminosilicate material can be prepared from certain faujasites by subjecting the latter to special treatment under specific conditions. Typical preparations of ultrastable, large-pore crystalline aluminosilicate material are considered in U.S. Pat. No. 3,293,192 and in U.S. Pat. No. 3,449,070. The preferred type of ultrastable, large-pore crystalline aluminosilicate material may be prepared by a method of preparation which usually involves a first step wherein most of the alkali metal cation is cation-exchanged with an ammonium salt solution to leave approximately enough alkali metal cations to fill the bridge positions in the faujasite structure. After this cation-exchange treatment, the aluminosilicate material is subjected to a heat treatment at a temperature within the range of about 1,292° F. (700° C.) to about 1,472° F. (800° C.). The heat-treated aluminosilicate material is then subjected to further cation-exchange treatment to remove additional residual alkali metal cations. The preferred material may be prepared by methods of preparation disclosed in U.S. Pat. No. 3,449,070 and by Procedure B presented in the paper "A New Ultra-Stable Form of Faujasite" by C. V. McDaniel and P. K. Maher, presented at a Conference on Molecular Sieves held in London, England in April, 1967. The paper was published in 1968 by the Society of Chemical Industry.

As the amount of alkali metal cations is reduced, the intensity of the unique infrared bands is attenuated. However, since the alkali metal cations are not removed completely from the preferred ultrastable aluminosilicate material, the unique infrared bands remain in its infrared spectra.

While it is preferable to employ the ultrastable, large-pore crystalline aluminosilicate material suspended in the porous matrix of the silica-alumina as the base for the hydrogenation component, the aluminosilicate component may be dispersed in or physically admixed with a porous matrix material of silica-alumina. Silica-alumina cracking catalyst containing from about 10 to 50 wt.% alumina is a preferred matrix material. The ultrastable, large-pore crystalline aluminosilicate material can be present in any suitable amount up to about 90 wt.%; typically, about 5 to 55 wt.% aluminosilicate is employed in preparing the hydrocracking catalysts of the process of the present invention. The aluminosilicatematrix catalyst support may be prepared by various well-known methods and shaped into pellets, pills, or extrudates. Advantageously, finely-divided ultrastable aluminosilicate material can be dispersed in a sol, hydrosol, or hydrogel of the silica-alumina and the resultant blend can then be dried, pelleted or extruded, dried, and calcined. The hydrogenation component can be placed conveniently on the catalyst support by impregnation through the use of one or more solutions of one or more of the metal components during the manufacture.

As discussed hereinabove, the hydrogenation components of the catalytic compositions of the present invention are (1) mixtures of a metal of Group VIII of the Periodic Table of Elements and a metal of Group VIB of the Periodic Table of Elements, (2) their oxides, (3) their sulfides, and (4) mixtures thereof. The Periodic Table of Elements referred to above is that found on page 628 of WEBSTER'S SEVENTH NEW COLLEGIATE DICTIONARY, G. & C. Merriam Company, Springfield, Massachusetts, U.S.A. (1963).

The reaction system of the process of the present invention can, for convenience, be divided into two zones, a first zone and a second zone. Each of these zones contains a hydrocracking catalyst. The first zone contains the first hydrocracking catalyst, while the second zone contains the second hydrocracking catalyst. The reaction section of the process can be divided into more than one reactor and such reactors may be connected in parallel. On the other hand, if a plurality of reactors is employed, the reactors could be connected in series. If the reactors are connected in parallel, each will contain the same distribution of the catalysts as is found in each of the other reactors. However, when the reactors are connected in series, only the first portion of the total reactor volume of the reactor section will contain the first catalyst, while the second or tail section of the total reactor volume will contain the second catalyst.

It is contemplated that the first catalyst will make up from about 10 wt.% to about 50 wt.% of the total catalyst that is employed in the process of the present invention. Preferably, the first catalyst will constitute about 15 wt.% to about 35 wt.% of the total catalyst in the reactor system.

The process of the present invention may be better understood by referring to the attached FIGURE, which is a simplified schematic flow diagram of a preferred embodiment of the process of the present invention. Various pieces of auxiliary equipment, such as pumps, compressors, heat exchangers, and valves are not shown. Those skilled in the art would recognize where such pieces of auxiliary equipment would be needed. Therefore, they have been omitted for simplification.

A light catalytic cycle oil fresh feed from source 10 is passed via line 11 and pumped by feed pump 12 through feed line 13, line 14, feed preheater 15, and line 16 into the top of reactor 17.

Reactor 17 is divided into two zones, each of which contains catalyst. Zone 18 contains the first hydrocracking catalyst, while zone 19 contains the second hydrocracking catalyst. The first hydrocracking catalyst comprises about 3 wt.% nickel and about 20 wt.% tungsten, calculated as NiO and $WO_3$, respectively, and based upon the weight of this first catalyst, deposed on a cocatalytic acidic cracking support comprising 35 wt.% ultrastable, large-pore crystalline aluminosilicate material suspended in and distributed throughout a matrix of high-alumina silica-alumina. The weight of the aluminosilicate material is based upon the weight of the cracking support. The second hydrocracking catalyst comprises about 3 wt.% cobalt and about 10 wt.% molybdenum, calculated as CoO and $MoO_3$, respectively, and based upon the weight of the second catalyst, deposed on a co-catalytic acidic cracking support that is the same as that described for the first catalyst. While only one reactor is shown in this simplified schematic flow diagram, it is to be understood that two other reactors containing the same types of catalysts are connected into the system in parallel with reactor 17. The first catalyst makes up about 35 wt.% of the total catalyst employed in the reactor. Each of the parallel reactors contains the same amount of the first catalyst and same amount of the total catalyst that is provided in reactor 17.

The operating conditions that are employed in this reactor system fall within the ranges of values for average catalyst bed temperature, pressure, LHSV, and hydrogen-to-hydrocarbon ratio described hereinabove.

The hydrocracking reaction is exothermic; therefore, the temperature of the reactants tends to increase as the reactants pass downward through the catalyst beds. In order to control the temperature rise and limit the maximum temperature within the reactor, a liquid quench stream can be introduced into the catalyst bed at about the middle thereof via line 20. This liquid quench is fresh feed from feed line 11 and/or recycled oil from recycle line 21 described hereinafter. A hydrogen-rich gas quench stream, described hereinbelow, is also introduced at about the same point in the reactor as that at which the liquid quench can be introduced. Advantageously, the gas quench is introduced through the same inlet nozzle as the liquid quench stream. However, it can also be introduced through line 22.

Effluent from the hydrocracking reactor 17 is passed via outlet line 23 through effluent cooler 24, and then through line 25, cooler 26, and line 27 into a high-pressure gas-liquid separator 28. Wash water is introduced via line 29 into line 25, wherein it is mixed with the hydrocracked effluent. Upon passing through cooler 26 and line 27, it separates as an aqueous phase in high-pressure separator 28. The wash water containing dissolved ammonia and hydrogen sulfide is withdrawn from high-pressure separator 28 via line 30. Gas which separates from the liquid in high-pressure separator 28 is withdrawn from the separator via line 31, compressed by gas compressor 32, and passed via line 33 into gas quench line 22. Of course, a portion of the gas is passed through line 34 and line 14 to be combined with the fresh feed from line 13 and then passed with the fresh feed via line 14 into feed pre-heater 15.

Liquid hydrocarbons are withdrawn from the high-pressure gas-liquid separator 28 and passed via line 35 into a low-pressure gas-liquid separator 36. The gas phase from the low-pressure separator, comprising light hydrocarbons and hydrogen, is withdrawn via line 37 as flash gases, which are conveniently used as fuel gas. The liquid hydrocarbon layer is withdrawn from the low-pressure separator 36 and is passed via line 38 to the distillation column 39 for fractionation into light gasoline, heavy gasoline, and bottoms fractions. The bottoms fraction is withdrawn from the distillation column 39 and recycled via line 40 by recycle pump 41, one portion through line 21 and heat exchanger 42 into line 20 and the hydrocracking reactor 17 and another portion through line 43 into the feed line 14 and feed preheater 15 to be admixed with fresh feed and hydrogen. Please note that make-up hydrogen, if needed, is passed from source 44 through line 45 into compressor 46 and line 47 to be joined with the recycled bottoms fraction from line 43. Such make-up-hydrogen stream can contain approximately 70 mole % hydrogen, or more, the remainder being methane, ethane, propane, and the like. A portion of the bottoms fraction can be withdrawn from the system via line 48, if desired.

Light hydrocracked gasoline distilled overhead in the distillation column 39 is withdrawn via line 49. A heavy gasoline side stream is withdrawn from the distillation column 39 via line 50 for use as hydroformer feed or for use in a gasoline blending system. Please note that while one distillation column has been shown for separation of the hydrocracked product, other satisfactory recovery systems will be apparent to those skilled in the art and are deemed to be within the scope of the present invention.

It is to be understood that the preceding flow scheme and the following examples are presented for the purpose of illustration only and are not to be regarded as limiting the scope of the present invention.

A particularly useful embodiment of the process of the present invention is a process wherein the catalyst in the first reaction zone is a fresh catalyst and the catalyst in the second reaction zone is a regenerated catalyst. Hence, one embodiment of the process of the present invention is an embodiment wherein the second catalyst is a catalyst that has been deactivated and then regenerated prior to its use in the process. The advantages obtained by such an embodiment are unexpected and surprising. An unexpectedly good overall activity and superior naphtha yields are obtained for the combination of a fresh catalyst comprising a hydrogenation component of nickel and tungsten followed by a regenerated catalyst containing a hydrogenation component comprising cobalt and molybdenum. This is shown hereinafter in Example VIII.

EXAMPLE I

Catalysts A and B were prepared by the Davison Chemical Division of W. R. Grace & Company.

Catalyst A was obtained in the form of ⅛-inch (0.32-cm) by ⅛-inch (0.32-cm) pellets and contained cobalt and molybdenum as hydrogenating metals. The cobalt was present in an amount of 2.82 wt.%, calculated as cobalt oxide, and the molybdenum was present in an amount of 10.55 wt.%, calculated as molybdenum trioxide. The catalyst support was composed of a high-alumina silica-alumina (approximately 25 wt.% alumina) and about 35 wt.% ultrastable, large-pore crystalline alumino-silicate material. Catalyst A had a surface area of 398 $m^2$/gm.

Catalyst B was obtained from the Davison Chemical Division in the form of approximately ⅛-inch (0.32-cm) extrudates and contained nickel and tungsten as hydrogenating metals. The nickel was present in an amount of 1.54 wt.%, calculated as nickel oxide, and the tungsten was present in an amount of 14.9 wt.%, calculated as tungsten trioxide. The catalyst support contained about 35 wt.% ultrastable, large-pore crystalline alumino-silicate material dispersed in a high-alumina silica-alumina (approximately 25 wt.% alumina). Catalyst B had a surface area of 374 $m^2$/gm.

EXAMPLE II

Catalysts A and B were tested in bench-scale test equipment for their respective abilities to hydrocrack a nitrogen-containing feedstock, the properties of which are presented hereinafter in Table I.

Table I

| Properties of Hydrocarbon Feedstock | | |
|---|---|---|
| Gravity, °API | 25.4 | |
| Density, kg/$m^3$ | 900.9 | |
| Specific Gravity, 60° F. | 0.9018 | |
| ASTM Distillation | °F. | °C. |
| IBP | 405 | 207 |
| 5% off | 457 | 236 |
| 10% | 477 | 247 |
| 20% | 498 | 259 |
| 30% | 514 | 268 |
| 40% | 524 | 273 |
| 50% | 538 | 281 |
| 60% | 551 | 288 |
| 70% | 570 | 299 |
| 80% | 591 | 311 |
| 90% | 621 | 327 |
| 95% | 640 | 338 |
| Sulfur, wt.% | 0.41 | |
| Total Nitrogen, ppm | 268 | |
| FIA Hydrocarbons, volume % | | |
| Saturates | 44 | |
| Olefins | 3 | |
| Aromatics | 53 | |
| Hydrogen, wt.% | 88.17 | |
| Carbon, wt.% | 11.45 | |

The reactor employed in the test unit had an inside diameter of 0.55 inch (1.40 cm) and was 19.5 inches (49.5 cm) in length. A ⅛-inch (0.32-cm) O.D. co-axial thermowell extended along the length of the reactor. A traveling thermocouple moved up and down inside the thermowell. The reactor was heated by a salt bath.

The hydrocarbon feed stream and once-through hydrogen were mixed and the resulting mixture was introduced into the top of the reactor. The effluent from the reactor was passed to a high-pressure separator wherein the gas was separated from the liquid product at reactor pressure and approximately room temperature. A liquid-level control valve regulated the flow rate of liquid from the high-pressure separator to a liquid product receiver, which was surrounded by a dry-ice bath. Gaseous products were passed from the high-pressure separator through a wet test meter and then to a vent or to a gas chromatographic instrument for analysis.

A catalyst was charged to the reactor such that a layer of 5 cc of glass beads (approximately 1/16-inch [0.16-cm] diameter) was located above and a layer was also located below the catalyst bed. Prior to being charged to the reactor, the catalyst was ground to a 12/20-mesh material, i.e., it was ground to pass through a 12-mesh screen (U.S. Sieve Series), but be retained on a 20-mesh screen. Before the catalyst sample was weighed, it was calcined at a temperature of 800° F. (427° C.) for 1 hour.

Each of the two catalysts received a pretreatment. Since Catalyst B contained nickel and tungsten, it required a pre-sulfiding treatment. Since Catalyst A contained cobalt and molybdenum, it received only a pre-reduction treatment. Such a catalyst is not affected by pre-sulfiding.

Catalyst B was pre-sulfided by passing a gas mixture of 8 mole % hydrogen sulfide in hydrogen over the catalyst at a temperature of 350° F. (177° C.), a pressure of 1 atmosphere (101 kPa), and a gas flow rate of 1 standard cubic foot per hour [SCFH] (0.028 $m^3$/hr) for 2 hours. The temperature was raised over several hours to 500° F. (260° C.) and the gas flow was terminated. The system was quickly pressured in hydrogen to 1,250 psig (8,720 kPa) and hydrogen flow was established at 2.40 SCFH (0.067 $m^3$/hr). Hydrocarbon flow was started at a rate of 32 cc/hr. and the temperature was raised slowly to achieve 77 wt.% conversion.

Catalyst A was pre-reduced. At a temperature of 500° F. (260° C.), the reactor was pressured to 1,250 psig (8,720 kPa) with hydrogen. The hydrogen flow rate was set at 2.40 SCFH (0.067 $m^3$/hr) and was continued overnight. After approximately 20 hours, hydrocarbon flow was started at a flow rate of 32 cc/hr. Gradually, the temperature was increased to obtain 77 wt.%, conversion.

The test employing Catalyst A is identified hereinafter as Test No. 1; the test employing Catalyst B, as Test No. 2. Test conditions and resultant data are presented hereinafter in Table II. The product yields were corrected to a WHSV of 1.42 and a temperature that furnishes 77 wt.% conversion. Each test was conducted at a pressure of 1,250 psig (8,720 kPa) and was conducted under substantially isothermal conditions.

EXAMPLE III

A test employing a catalyst bed comprising 50% Catalyst A and 50% Catalyst B was carried out. The test equipment used was similar to that described in Example II. The feedstock described in Table I was employed. The top of the catalyst bed was made up of Catalyst B while the bottom of the bed contained Catalyst A. The bed contained 10 grams (22 cc) of Catalyst B followed by 10 grams (18 cc) of Catalyst A and was pre-sulfided as described in Example II, except that the pre-sulfiding temperature was 400° F. (204° C.) rather than 350° F. (177° C.). Each catalyst was used in the form of 12/20-mesh material and was calcined at 800° F. (427° C.) for 1 hour before being weighed. This test, identified as Test No. 3, was made at a pressure of 1,250 psig (8,720 kPa). Relevant test data are presented in Table II.

Various calculations were employed in obtaining portions of the data in this example and subsequent examples.

As used herein, conversion is defined as the percent of the total reactor effluent, both gas and liquid, that boils below a true boiling point of 380° F. This percent was determined by gas chromatography. The hydrocarbon product was sampled for analysis at intervals of not less than 24 hours. The sampling period was two hours, during which time the liquid product was collected under a dry-ice-acetone condenser to insure condensation of pentanes and heavier hydrocarbons. During this time, the hydrogen-rich off-gas was sampled and immediately analyzed for light hydrocarbons by isothermal gas chromatography. The liquid product was weighed and analyzed using a dual-column temperature-programmed gas chromatograph. Individual compounds were measured through methylcyclopentane. The valley in the chromatograph just ahead of the n-undecane peak was taken as the 380° F. (193° C.) point. The split between light and heavy naphtha (180° F.) (82° C.) was arbitrarily selected as a specific valley within the $C_7$-paraffin-naphthene group to conform with the split obtained by Oldershaw distillation of the product.

Temperature requirements for 77 percent conversion were calculated from the observed data by means of zero order kinetics and an activation energy of 35 kilocalories. Adjustment in temperature requirement was made also to a constant hydrogen-to-oil ratio of 12,000 SCFB (2,136 $m^3/m^3$) using the equation:

$$\Delta T°F = (1.3)(R\text{-}12)$$

where R is the gas rate in 1,000 SCFB (178 $m^3/m^3$).

The temperature required for 77 percent conversion at a WHSV of 1.42 was selected as the means for expressing the hydrocracking activity of the catalyst being tested. To eliminate irregular values that might be present at the start of the run, an estimated value for the temperature required for 77 percent conversion at 7 days on stream was obtained for the catalyst. To estimate these values, a plot showing the temperatures required for 77 percent conversion as ordinates and days on stream as abscissae was prepared and the value of the temperature at 7 days on stream was read from the smooth curve of this plot. This latter value was used to determine the activity of the catalyst that was employed in the test from which the plotted data were obtained.

The relative hydrocracking activity was obtained by using the following equation:

$$A = 100e - \frac{\Delta E}{R} \cdot \left[\frac{1}{T_o} - \frac{1}{T}\right], \text{where}$$

A = the relative activity of the tested catalyst;
$\Delta E$ = 35,000 calories per gram-mole;
R = 1.987 calories per gram-miole per °K.;
T = the temperature in °K. required for 77 wt.% conversion at a WHSV of 1.42 and a hydrogen rate of 12,000 SCFB (2,136 $m^3/m^3$); and
$T_o$ = 652° K.

The yield of each product component "i" was calculated by using the following equations:

$$Y_{725} = Y_{OBS} + d_i \log\left(\frac{23}{100 - C_{OBS}}\right) + a_i\left(\frac{1}{658.2} - \frac{1}{T_{OBS}}\right) + b_i\left(\frac{1}{658.2} - \frac{1}{T_{OBS}}\right)^2 \quad \text{(I)}$$

$$Y = Y_{725} - a_i\left(\frac{1}{658.2} - \frac{1}{T}\right) - b_i\left(\frac{1}{658.2} - \frac{1}{T}\right)^2 \quad \text{(II)}$$

$$T = \frac{1}{\frac{1}{T_{OBS}} + \frac{1.987}{35{,}000} \ln\left(\frac{C_{OBS} \times WHSV_{OBS}}{77 \times 1.42}\right)} + 0.72\,(R\text{-}12) \quad \text{(III)}$$

wherein

Y = the yield at a WHSV of 1.42, a hydrogen rate of 12,000 SCFB (2,136 $m^3/m^3$), and 77 wt.% conversion;
$Y_{725}$ = the yield at 725° F. and 77 wt.% conversion;
$Y_{OBS}$ = the observed yield;
$d_i$ = the yield-conversion correction coefficient for the component i (please see hereinbelow for values);
$C_{OBS}$ = the observed conversion in wt.%;
$T_{OBS}$ = the observed temperature in °K.;
T = the temperature in °K. required for 77 wt.% conversion at a WHSV of 1.42 and a hydrogen rate of 12,000 SCFB (2,136 $m^3/m^3$);
$a_i$ = a temperature correction coefficient for the component i (see hereinbelow for values);
$b_i$ = a temperature correction coefficient for the component i (see hereinbelow for values);
$WHSV_{OBS}$ = the observed WHSV;
R = the gas rate in 1,000 SCFB (178 $m^3/m^3$);

and the values for $a_i$, $b_i$, and $d_i$ are:

| | WT.% | | | | |
|---|---|---|---|---|---|
| CORRECTION COEFFICIENT | DRY GAS | $C_4$'s | $C_5$'s | LIGHT NAPHTHA | HEAVY NAPHTHA |
| CONVERSION, $d_i$ | −1 | −9 | −6 | −3 | 19 |
| TEMPERATURE, $a_i \times 10^{-4}$ | −5.5 | −4.5 | −4.0 | −1.0 | 15 |
| $b_i \times 10^{-8}$ | −3.5 | −2.5 | −2.0 | −1.0 | 9 |
| CORRECTION COEFFICIENT | | i-$C_4$ n-$C_4$ | i-$C_5$ n-$C_5$ | | |
| CONVERSION, $d_i$ | | 0 | −3 | | |
| TEMPERATURE, $a_i \times 10^{-4}$ | | 0 | 0.5 | | |
| $b_i \times 10^{-8}$ | | 0 | 3.5 | | |

A comparison of the data obtained from Tests Nos. 1, 2, and 3 shows that the dual-catalyst system provides somewhat improved naphtha yields over those furnished by the system employing the catalyst containing cobalt and molybdenum, i.e., Catalyst A. In addition, the activity of the dual-catalyst system was substantially higher than the activity of Catalyst A shown in Test No. 1.

TABLE II

Data Obtained From Tests Nos. 1, 2 and 3

| Test No. | Catalyst | Days on Stream | Temp. °F. | Temp. °C. | WHSV | Hydrogen, SCFB |
|---|---|---|---|---|---|---|
| 1 | A | 5 | 702 | 372 | 1.42 | 11,800 |
| | | 6 | 708 | 376 | 1.39 | 12,000 |
| | | 7 | 708 | 376 | 1.38 | 11,800 |
| 2 | B | 2 | 671 | 355 | 1.33 | 8,400 |
| | | 4 | 691 | 366 | 1.29 | 12,300 |
| | | 10 | 691 | 366 | 1.30 | 11,900 |
| | | 15 | 690 | 366 | 1.66 | 11,100 |
| 3 | 50% A | 2 | 682 | 361 | 1.22 | 14,700 |
| | + | 3 | 691 | 366 | 1.32 | 13,900 |
| | 50% B | 6 | 704 | 373 | 1.17 | 15,500 |

| Test No. | Days on Stream | Hydrogen, $m^3/m^3$ | Rel. Activity | Conversion, Wt. % |
|---|---|---|---|---|
| 1 | 5 | 2,102 | 111 | 62.3 |
| | 6 | 2,137 | 112 | 73.9 |
| | 7 | 2,102 | 112 | 74.7 |
| 2 | 2 | 1,496 | 187 | 48.0 |
| | 4 | 2,191 | 191 | 91.9 |
| | 10 | 2,119 | 184 | 87.3 |
| | 15 | 1,977 | 200 | 71.7 |
| 3 | 2 | 2,618 | 141 | 62.9 |
| | 3 | 2,476 | 144 | 71.0 |
| | 6 | 2,761 | 115 | 91.2 |

Corrected Product Data*

| Test No. | Days on Stream | Yields, Wt. % Dry Gas | $C_4$'s | $C_5$'s | Light Naphtha | Heavy Naphtha | i-$C_4$/n-$C_4$ | i-$C_5$/n-$C_5$ |
|---|---|---|---|---|---|---|---|---|
| 1 | 5 | 5.4 | 13.1 | 12.3 | 14.9 | 57.2 | 1.34 | 5.58 |
| | 6 | 4.9 | 12.2 | 11.8 | 15.0 | 59.1 | 1.38 | 5.45 |
| | 7 | 5.1 | 12.3 | 11.5 | 15.0 | 59.1 | 1.37 | 5.67 |
| 2 | 2 | 3.9 | 11.5 | 10.6 | 15.3 | 61.7 | 1.37 | 3.94 |
| | 4 | 2.7 | 8.1 | 8.2 | 17.1 | 66.8 | 1.84 | 1.44 |
| | 10 | 3.2 | 9.9 | 9.8 | 16.4 | 63.6 | 1.87 | 2.19 |
| | 15 | 3.0 | 10.6 | 10.5 | 15.6 | 63.3 | 1.54 | 2.95 |
| 3 | 2 | 5.1 | 12.0 | 11.5 | 15.1 | 59.4 | 1.42 | 3.75 |
| | 3 | 3.6 | 10.8 | 11.2 | 15.9 | 61.4 | 1.35 | 3.69 |
| | 6 | 5.0 | 11.1 | 10.8 | 16.1 | 60.2 | 1.53 | 2.51 |

*Corrected to a WHSV of 1.42 and a 77 wt. % conversion.

EXAMPLE IV

Catalysts A and B were also tested at high space velocities. Each catalyst was employed in the form of 12/20-mesh material and was calcined at 800° F. (427° C.) for 1 hour prior to being weighed. The test employing Catalyst A is hereinafter identified as Test No. 4 and the test employing Catalyst B is hereinafter identified as Test No. 5. The test equipment employed in each test was similar to that described in Example II. The feedstock described in Table I was used. The results of these tests provide some explanation for the improved performance of the two-catalyst system, represented in Test No. 3 that is described hereinabove.

Catalyst A was pre-reduced. At a temperature of 500° F. (260° C.), the reactor was pressured to 1,250 psig (8,720 kPa) with hydrogen. The hydrogen flow rate was set at 2.25 SCFH (0.064 $m^3$/hr). These conditions were maintained overnight, i.e., for approximately 18 hours. Then the temperature was increased to 600° F. (316° C.) and the hydrocarbon stream was introduced into the reactor at a rate of 30 cc/hr. The temperature was gradually raised to 670° F. (354° C.) over a period of 2 hours.

Catalyst B was pre-sulfided by passing a gas mixture of 8 mole % hydrogen sulfide in hydrogen over the catalyst at a temperature of 450° F. (232° C.), a pressure of 1 atmosphere (101 kPa), and a gas flow rate of 1 SCFH (0.028 $m^3$/hr) for 2 hours. When the gas flow was terminated, the system was quickly pressured in hydrogen to 1,250 psig (8,720 kPa) and hydrogen flow was established at 2.25 SCFH (0.064 $m^3$/hr). Hydrocarbon flow was initiated at the rate of 30 cc/hr. The temperature was gradually raised to 670° F. (354° C.).

Each catalyst was tested at two WHSV values, namely, 6.7 weight units of hydrocarbon per hour per weight unit of catalyst and 13.3 weight units of hydrocarbon per hour per weight unit of catalyst.

In each case, the products were analyzed for nitrogen content by the coulometric nitrogen method and for naphthalenes by mass spectra analysis. The results of these analyses are provided in Table III hereinafter. In the case of Test No. 4, 2.0 gm of Catalyst A were diluted with 18 gm of glass chips to make up the catalyst bed. The catalyst bed occupied a volume of 19.8 cc. In the case of Test No. 5, 2.0 gm of Catalyst B were diluted with 18 gm of glass chips to make up the catalyst bed, which occupied a volume of 19.2 cc. All glass chips were in the form of 12/20-mesh material.

TABLE III

TESTS AT HIGH WHSV

| FEED TEST NO. | CATALYST | DAYS ON STREAM | WHSV | NITROGEN, ppm | NAPHTHALENES, WT.% |
|---|---|---|---|---|---|
| | — | — | — | 265 | 20.5 |
| 4 | A | 32 | 6.7 | 30 | 14.8 |
| 4 | A | 114 | 13.3 | 113 | 18.0 |
| 5 | B | 11 | 6.7 | 11 | 4.3 |
| 5 | B | 70 | 13.3 | 70 | 9.3 |

The data provided in Table III, based on first order kinetics, indicate that Catalyst B is approximately 1.5 times as active as Catalyst A for denitrogentation and approximately 4 times as active as Catalyst A for the saturation of aromatics. The use of a catalyst such as Catalyst B as the first catalyst in a dual-catalyst system substantially increases the rate of removal of both nitrogen and polyaromatics, which are inhibitors of the cracking reactions. Such increased removal of such inhibitors permits more of the catalyst to provide the primary cracking reactions. As a result, lower operating temperatures can be employed or, alternatively, feeds containing higher contents of nitrogen and aromatics can be processed suitably.

EXAMPLE V

Catalysts C and D were prepared by the Davison Chemical Division of W. R. Grace & Company. The catalysts were obtained in the form of ⅛-inch (0.32-cm)×⅛-inch (0.32-cm) pellets. The support of each contained a high-alumina silica-alumina (approximately 25 wt.% alumina) as the matrix in which the ultrastable, large-pore crystalline aluminosilicate was suspended. Catalyst C contained cobalt and molybdenum as hydrogenating metals, while Catalyst D contained nickel and tungsten as hydrogenating metals.

The various properties and components of Catalyst C and D are presented hereinafter in Table IV.

TABLE IV

PROPERTIES OF CATALYSTS C AND D

| CATALYST | C | D |
|---|---|---|
| COMPONENT, WT.% | | |
| CoO | 2.62 | — |
| $MoO_3$ | 10.60 | — |
| NiO | — | 2.16 |
| $WO_3$ | — | 17.90 |

TABLE IV-continued

| PROPERTIES OF CATALYSTS C AND D | | |
|---|---|---|
| CATALYST | C | D |
| Na | 0.31 | 0.34 |
| S | 0.06 | 0.06 |
| Volatiles | 0.8 | 1.3 |
| Sieve Content, wt.% in Base | 41 | 41 |
| Surface Area, $m^2/gm$ | 435 | 389 |
| Bulk Density, $lb./ft^3$ | 42.0 | 48 |
| $kg/m^3$ | 680 | 771 |
| Crushing Strength, lb | 28.2 | 35.0 |
| kg | 12.8 | 15.8 |
| Abrasion loss, wt.% | 1.0 | 1.0 |

EXAMPLE VI

Tests Nos. 6 and 7 were conducted in bench-scale test equipment similar to that described hereinabove in Example II. The feedstock described in Table I was employed.

For Test No. 6, 20.0 gm (38.8 cc) of Catalyst C were charged to the reactor. For Test No. 7, 7.0 gm (11.6 cc) of Catalyst D were charged to the reactor on top of 13.0 gm (23.0 cc) of Catalyst C. Therefore, in the case of Test No. 7, the catalyst system consisted of 35 wt.% Catalyst D followed by 65 wt.% Catalyst C. Each catalyst was used in the form of 12/20-mesh material and was calcined at 800° F. (427° C.) for 1 hour before being weighed.

In Test No. 6, the catalyst received a hydrogen pretreatment. The reactor at a temperature of 500° F. (260° F.) was pressured with hydrogen to a pressure of 1,250 psig (8,720 kPa) and a hydrogen flow rate was established at 2.40 SCFH (0.067 $m^3/hr$). After two hours of uninterrupted hydrogen flow, the hydrocarbon feed was introduced into the reactor at a rate of 32 cc/hr. The temperature was gradually raised to 680° F. (360° C.) over a period of approximately 6 hours. The 680° F. (360° C.) temperature was held overnight, i.e., for approximately 18 hours. The next day, the temperature was increased to obtain 77% conversion of the feedstock.

In the case of Run No. 7, the dual-catalyst system was pre-sulfided. At a pressure of 1 atmosphere (101 kPa) and a temperature of 350° F. (177° C.), a gas mixture containing 8 mole % hydrogen sulfide in hydrogen was passed through the catalyst bed overnight, i.e., for approximately 18 hours. The next day, the temperature was raised gradually to 700° F. (371° C.) and held at that level for 2 hours, while the gas mixture was passed through the catalyst bed. The temperature was then decreased to 500° F. (260° C.) and the flow of gas mixture was terminated. Immediately, the system was pressured with hydrogen to a pressure of 1,250 psig (8,720 kPa) and a hydrogen flow rate of 2.40 SCFH (0.067 $m^3/hr$) was established. The hydrocarbon feed was introduced into the system at a rate of 32 cc/hr. The temperature was slowly increased to a level that would provide 77 wt.% conversion.

Data obtained from Tests Nos. 6 and 7 are presented in Table V hereinafter.

TABLE V

Data Obtained From Test Nos. 6 and 7

| Test No. | Days on Stream | Temp., °F. | Temp., °C. | Hydrogen WHSV | Hydrogen SCFB | Hydrogen $m^3/m^3$ | Relative Activity |
|---|---|---|---|---|---|---|---|
| 6 | 7 | 703 | 373 | 1.47 | 11,500 | 2,050 | 128 |
| | 8 | 705 | 374 | 1.46 | 11,600 | 2,070 | 130 |
| | 9 | 705 | 374 | 1.45 | 11,800 | 2,100 | 133 |
| | 12 | 705 | 374 | 1.44 | 11,800 | 2,100 | 129 |
| 7 | 5 | 703 | 373 | 1.35 | 11,900 | 2,120 | 147 |
| | 8 | 696 | 369 | 1.47 | 11,800 | 2,100 | 153 |
| | 10 | 696 | 369 | 1.48 | 11,700 | 2,080 | 157 |
| | 13 | 696 | 369 | 1.44 | 11,800 | 2,100 | 149 |
| | 14 | 696 | 369 | 1.43 | 11,700 | 2,080 | 148 |

| Test No. | Days on Stream | Conversion, Wt.% | Corrected Product Data* Yields, Wt. % Dry Gas | $C_4$'s | $C_5$'s |
|---|---|---|---|---|---|
| 6 | 7 | 72.6 | 2.3 | 8.8 | 10.6 |
| | 8 | 76.8 | 2.2 | 8.9 | 11.1 |
| | 9 | 79.5 | 2.1 | 8.3 | 11.1 |
| | 12 | 78.3 | 2.2 | 8.5 | 10.9 |
| 7 | 5 | 91.7 | 1.6 | 5.8 | 8.7 |
| | 8 | 72.8 | 2.0 | 8.2 | 10.0 |
| | 10 | 75.2 | 1.9 | 8.1 | 10.6 |
| | 13 | 72.8 | 1.9 | 8.1 | 10.0 |
| | 14 | 74.0 | 1.9 | 8.2 | 10.1 |

| Test No. | Days on Stream | Corrected Product Data* Yields, Wt. % Light Naphtha | Heavy Naphtha | $i\text{-}C_4$ / $n\text{-}C_4$ | $i\text{-}C_5$ / $n\text{-}C_5$ |
|---|---|---|---|---|---|
| 6 | 7 | 16.4 | 68.4 | 1.32 | 4.89 |
| | 8 | 17.4 | 63.4 | 1.36 | 5.00 |
| | 9 | 16.5 | 64.9 | 1.37 | 4.34 |
| | 12 | 16.4 | 65.0 | 1.37 | 5.40 |
| 7 | 5 | 16.9 | 69.8 | 1.61 | 2.50 |
| | 8 | 16.1 | 66.8 | 1.40 | 3.76 |
| | 10 | 16.4 | 66.1 | 1.41 | 3.26 |
| | 13 | 16.0 | 66.8 | 1.39 | 4.06 |
| | 14 | 16.2 | 66.7 | 1.22 | 3.97 |

*Corrected to WHSV = 1.42 and 77% conversion.

The qualities of the products obtained from Tests Nos. 6 and 7 were compared. Twenty-four-hour samples were obtained from the runs while the tests were being conducted under stable conditions. In the case of Test No. 6, the sample was obtained during the ninth day on stream. In the case of Test No. 7, the sample was taken during the 35th day on stream. Product qualities were obtained by means of elemental analyses and mass-spectra and gas-chromatographic techniques. The liquid product was fractionated in a 6-plate Oldershaw atmospheric column to separate a 380° F.− (193° C.−) naphtha fraction and a 380° F.+ (193° C.+) distillate fraction.

Total yields and process conditions for the product quality cuts from these two tests are summarized in Table VI. Detailed analyses of the naphtha products based upon the naphtha and based upon the feed are provided in Table VII. The naphtha product distribution, based upon feed and extrapolated to 77 wt.% conversion, is presented in Table VIII. Naphtha is defined as all of the material boiling above normal-$C_5$ and less than 380° F. (193° C.).

The data obtained from these tests demonstrate that the total naphtha provided by the dual-catalyst system containing Catalyst D followed by Catalyst C is approximately 3% higher than that obtained for the catalyst system containing only Catalyst C. Furthermore, although aromatics are slightly lower, the total aromatics and naphthenes for the dual-catalyst system are higher than those obtained from the test employing only Catalyst C. In addition, there was essentially no change in the hydrogen consumption when the dual-catalyst system was employed and the reactor temperature was somewhat reduced.

TABLE VI

COMPARISON OF YIELDS FROM TEST NOS. 6 AND 7

| TEST NO. | 6 | 7 |
|---|---|---|
| CATALYSTS | C | D + C |
| OPERATING CONDITIONS | | |
| PRESSURE, | | |
| psig | 1,250 | 1,250 |
| kPa | 8,720 | 8,720 |
| TEMPERATURE, | | |
| °F. | 705 | 701 |
| °C. | 374 | 372 |
| WHSV | 1.45 | 1.44 |
| HYDROGEN/OIL, | | |
| SCFB | 11,800 | 12,500 |
| $m^3/m^3$ | 2,100 | 2,230 |
| CONVERSION, WT.% | 79.5 | 79.4 |
| CONVERSION, VOL.% | 76.4 | 77.3 |

| | YIELDS | | | |
|---|---|---|---|---|
| | WT. % OF FEED | | VOL. % OF FEED | |
| TEST NO. | 6 | 7 | 6 | 7 |
| COMPONENT | | | | |
| $H_2$ | −2.93 | −2.94 | −1740* | −1750* |
| $H_2S$ | 0.33 | 0.33 | 11* | 11* |
| $NH_3$ | 0.03 | 0.03 | 2* | 2* |
| $C_1$ | 0.01 | 0.01 | 1* | 1* |
| $C_2$ | 0.13 | 0.11 | 5* | 4* |
| $C_3$ | 1.76 | 1.55 | 3.13 | 2.75 |
| $C_4$ | 7.25 | 6.66 | 11.40 | 10.54 |
| $C_5$-$C_6$ | 18.76 | 19.01 | 25.41 | 25.61 |
| P | | | 82.4 | 79.9 |
| N | | | 13.3 | 15.7 |
| A | | | 4.3 | 4.4 |
| $C_7$-380° F. | 52.98 | 54.61 | 60.60 | |
| P | | | 31.9 | 33.1 |
| N | | | 39.6 | 39.5 |
| A | | | 28.5 | 27.4 |
| Distillate | 21.68 | 20.63 | 23.60 | |
| P | | | 41.5 | 45.0 |
| N | | | 18.6 | 20.2 |
| A | | | 39.9 | 34.8 |

| TEST NO. ISO/NORMAL RATIOS | 6 | 7 |
|---|---|---|
| C4 | 1.37 | 1.39 |
| C5 | 4.92 | 4.42 |
| C6 | 9.17 | 7.71 |
| C7 | 16.50 | 13.93 |

*EXPRESSED AS SCFB

TABLE VII

DISTRIBUTION OF NAPHTHA HYDROCARBON TYPES IN PRODUCTS OBTAINED FROM TESTS NOS. 6 AND 7 AMOUNT-VOL % ON NAPHTHA

| TEST NO. | 6 | | 7 | |
|---|---|---|---|---|
| CATALYST COMPONENT | C | | D + C | |
| PARAFFINS | 36.60 | | 38.30 | |
| $C_6$ | | 10.80 | | 11.09 |
| $C_7$ | | 7.90 | | 9.10 |
| $C_8$ | | 8.70 | | 7.82 |
| $C_{9+}$ | | 9.21 | | 10.29 |
| NAPHTHENES | 38.07 | | 37.71 | |
| $C_5$ | | 0.20 | | 0.19 |
| $C_6$ | | 4.45 | | 5.07 |
| $C_7$ | | 8.32 | | 10.41 |
| $C_8$ | | 11.66 | | 9.61 |
| $C_{9+}$ | | 13.44 | | 12.43 |
| AROMATICS | 25.33 | | 23.99 | |
| $C_6$ | | 1.50 | | 1.48 |
| $C_7$ | | 4.46 | | 5.20 |
| $C_8$ | | 10.60 | | 8.62 |
| $C_{9+}$ | | 8.77 | | 8.69 |
| TOTAL | 100.00 | | 100.00 | |

TABLE VII-continued

DISTRIBUTION OF NAPHTHA HYDROCARBON TYPES IN PRODUCTS OBTAINED FROM TESTS NOS. 6 AND 7 AMOUNT-VOL % ON NAPHTHA

| | AMOUNT-VOL% ON FEED | | | |
|---|---|---|---|---|
| TEST NO. | 6 | | 7 | |
| CATALYST COMPONENT | C | | D + C | |
| PARAFFINS | 26.70 | | 29.06 | |
| $C_6$ | | 7.88 | | 8.41 |
| $C_7$ | | 5.76 | | 6.90 |
| $C_8$ | | 6.35 | | 5.93 |
| $C_{9+}$ | | 6.72 | | 7.81 |
| NAPHTHENES | 27.78 | | 28.61 | |
| $C_5$ | | 0.15 | | 0.11 |
| $C_6$ | | 3.25 | | 3.85 |
| $C_7$ | | 6.07 | | 7.90 |
| $C_8$ | | 8.51 | | 7.29 |
| $C_{9+}$ | | 9.81 | | 9.43 |
| AROMATICS | 18.48 | | 18.20 | |
| $C_6$ | | 1.09 | | 1.12 |
| $C_7$ | | 3.25 | | 3.95 |
| $C_8$ | | 7.73 | | 6.54 |
| $C_{9+}$ | | 6.40 | | 6.59 |
| TOTAL | 72.96 | | 75.87 | |

| CORRECTED AMOUNT-VOL. % ON FEED* | | | | |
|---|---|---|---|---|
| TEST NO. | 6 | | 7 | |
| CATALYST COMPONENT | C | | D + C | |
| PARAFFINS | 26.19 | | 28.52 | |
| $C_6$ | | 7.73 | | 8.25 |
| $C_7$ | | 5.65 | | 6.77 |
| $C_8$ | | 6.23 | | 5.82 |
| $C_{9+}$ | | 6.59 | | 7.66 |
| NAPHTHENES | 27.25 | | 28.08 | |
| $C_5$ | | 0.15 | | 0.11 |
| $C_6$ | | 3.19 | | 3.78 |
| $C_7$ | | 5.95 | | 7.75 |
| $C_8$ | | 8.35 | | 7.15 |
| $C_{9+}$ | | 9.62 | | 9.25 |
| AROMATICS | 18.13 | | 17.86 | |
| $C_6$ | | 1.07 | | 1.10 |
| $C_7$ | | 3.19 | | 3.88 |
| $C_8$ | | 7.58 | | 6.42 |
| $C_{9+}$ | | 6.28 | | 6.47 |
| TOTAL | 71.58 | | 74.45 | |

*CORRECTED TO 77 WT.% CONVERSION

EXAMPLE VII

Several samples of commercial hydrocracking catalyst were removed from a commercial unit after they had been aged for 5 years in the commercial unit and were regenerated by a commercial regeneration service. Equal amounts of 8 of these samples were combined to provide a regenerated catalyst, identified hereinafter as Catalyst E.

In addition, another sample of commercial catalyst was removed from the commercial unit after 5 years of aging and was regenerated commercially. This catalyst is identified hereinafter as Catalyst F.

The properties of Catalysts E and F are presented hereinafter in Table VIII. Both Catalyst E and Catalyst F were in the form of ⅛-inch (0.32-cm)×⅛-inch (0.32-cm) pellets. The support of each contained approximately 36 wt.% ultrastable, large-pore crystalline aluminosilicate material suspended in and distributed throughout a matrix of low-alumina silica-alumina (approximately 12 wt.% alumina). Both contained cobalt and molybdenum as hydrogenating metals.

TABLE VIII

| Properties Of Regenerated Catalysts | | | | | |
|---|---|---|---|---|---|
| Catalyst | Sample No. | Surface Area, $m^2/gm$ | Unit Cell Size A | % Crystallinity | Carbon On Cat., WT.% |
| E | 1 | 344 | | 89 | 0.18 |
| | 2 | 322 | | 93 | 0.03 |
| | 3 | 360 | | 93 | 0.03 |
| | 4 | 359 | | 94 | 0.03 |
| | 5 | 290 | | 95 | 0.14 |
| | 6 | 361 | | 106 | 0.16 |
| | 7 | 340 | | 100 | 0.20 |
| | 8 | 347 | | 100 | 0.20 |
| E | composited average | 340 | | 96 | 0.12 |
| E | composite | | 24.37 | | 0.14 |
| F | | 319 | 24.40 | | 0.54 |

| Catalyst | CoO Wt.% | $MoO_3$, Wt.% |
|---|---|---|
| E | 2.39 | 9.64 |
| F | 2.39 | 9.64 |

EXAMPLE VIII

Tests Nos. 8 and 9 were conducted in bench-scale test equipment similar to that described hereinabove in Example II. The feedstock described in Table I was employed.

For Test No. 8, 7.0 gm (11.6 cc) of Catalyst D were charged to the reactor on top of 13.0 gm (23.0 cc) of Catalyst E. Therefore, for this test, the catalyst system consisted of 35 wt.% Catalyst D followed by 65 wt.% Catalyst E. For Test No. 9, 20.0 gm (34.0 cc) of Catalyst F were charged to the reactor. Each catalyst was employed in the form of 12/20-mesh material and was calcined at 800° F. (427° C.) for 1 hour prior to being weighed.

For Test No. 8, the dual-catalyst system was presulfided according to the pre-sulfiding treatment described hereinabove in Example VI for the dual-catalyst system in Test No. 7.

For Test No. 9, the catalyst received a hydrogen pretreatment as described hereinabove in Example VI for Test No. 6.

Data obtained from Tests Nos. 8 and 9 are presented in Table IX hereinafter.

TABLE IX

| Data Obtained From Test Nos. 8 and 9 | | | | | | | |
|---|---|---|---|---|---|---|---|
| Test No. 1 | Days on Stream | Temp., °F. | Temp., °C. | WHSV | Hydrogen, SCFB | Hydrogen, $m^3/m^3$ | Relative Activity |
| 8 | 5 | 704 | 373 | 1.45 | 11,100 | 1,980 | 125 |
| | 6 | 694 | 368 | 1.45 | 11,200 | 1,990 | 151 |
| | 7 | 709 | 376 | 1.37 | 12,100 | 2,150 | 110 |
| | 12 | 697 | 370 | 1.39 | 11,300 | 2,010 | 121 |
| | 13 | 699 | 371 | 1.38 | 11,900 | 2,120 | 130 |
| | 15 | 700 | 371 | 1.39 | 11,800 | 2,100 | 127 |
| 9 | 7 | 726 | 386 | 1.38 | 11,600 | 2,070 | 73 |
| | 8 | 723 | 384 | 1.39 | 11,500 | 2,050 | 74 |
| | 11 | 726 | 386 | 1.37 | 11,800 | 2,100 | 68 |
| | 12 | 726 | 386 | 1.70 | 9,400 | 1,670 | 67 |

| | | | Corrected Product Data* Yields, Wt. % | | | | |
|---|---|---|---|---|---|---|---|
| Test No. | Days on Stream | Conversion Wt. % | Dry Gas | $C_4$'s | $C_5$'s | Light Naphtha | Heavy Naphtha |
| 8 | 5 | 70.9 | 2.3 | 9.0 | 10.5 | 16.5 | 64.8 |
| | 6 | 69.1 | 1.2 | 7.2 | 10.4 | 17.0 | 67.2 |
| | 7 | 77.4 | 2.3 | 8.5 | 10.2 | 16.8 | 65.2 |
| | 12 | 62.2 | 2.5 | 9.2 | 10.3 | 16.5 | 64.4 |
| | 13 | 72.2 | 2.3 | 8.7 | 10.5 | 16.5 | 65.1 |
| | 15 | 70.3 | 2.4 | 9.0 | 10.6 | 16.4 | 64.7 |
| 9 | 7 | 74.5 | 2.5 | 9.4 | 11.3 | 17.2 | 62.6 |
| | 8 | 70.3 | 2.6 | 9.7 | 11.6 | 16.9 | 62.2 |
| | 11 | 70.3 | 2.6 | 9.3 | 11.4 | 17.0 | 62.6 |
| | 12 | 51.7 | 2.9 | 10.8 | 12.1 | 17.1 | 60.1 |

| | | Corrected Product Data* | |
|---|---|---|---|
| Test No. | Days On Stream | $i-C_4$ / $n-C_4$ | $i-C_5$ / $n-C_5$ |
| 8 | 5 | 1.46 | 4.02 |
| | 6 | 1.34 | 3.55 |
| | 7 | 1.46 | 3.62 |
| | 12 | 1.34 | 4.63 |
| | 13 | 1.44 | 4.56 |
| | 15 | 1.41 | 4.81 |
| 9 | 7 | 1.32 | 8.07 |
| | 8 | 1.31 | 8.49 |
| | 11 | 1.28 | 7.27 |
| | 12 | 1.11 | 8.48 |

*Data corrected to WHSV = 1.42 and 77% conversion.

Test No. 8 illustrates the marked improvement in both activity and heavy naphtha yield which are obtained when employing a catalyst system containing 35 wt.% Catalyst D followed by 65 wt.% regenerated Catalyst E. This dual-catalyst system has an initial activity and yield structure that are equivalent to those furnished by the system of fresh catalyst containing cobalt and molybdenum as hydrogenating metals, which catalyst is described in Test No. 6 hereinabove.

EXAMPLE IX

An additional catalyst containing nickel and molybdenum as hydrogenating metals was prepared. A support material containing approximately 38 wt.% ultrastable, large-pore crystalline aluminosilicate material suspended in and distributed throughout a matrix of high-alumina silica-alumina (approximately 25 wt.% alumina) was obtained from the Davison Chemical Division of W. R. Grace & Company in the form of $\frac{1}{8}$-inch (0.32-cm)$\times\frac{1}{8}$-inch (0.32-cm) pellets. The catalyst was prepared to contain 2.7 wt.% nickel, calculated as NiO and based upon the weight of the catalyst, and 10.0 wt.% molybdenum, calculated as MoO3 and based upon the weight of the catalyst. This catalyst is hereinafter identified as Catalyst G.

EXAMPLE X

Test No. 10 was conducted in a bench-scale test unit similar to that described hereinabove in Example II. The feedstock described in Table I was employed.

For this Test No. 10, 20 gm (32 cc) of Catalyst G in the form of 12/20-mesh material were charged to the reactor. The catalyst had been calcined at 800° F. (427° C.) for 1 hour prior to being weighed.

For this Test No. 10, Catalyst G received a presulfiding treatment. At a pressure of 1 atmosphere (101 kPa) and a temperature of 400° F. (204° C.), a gas mixture containing 8 mole % hydrogen sulfide in hydrogen was passed through the catalyst bed for 2 hours. The flow of gas mixture was terminated and the system was immediately pressured with hydrogen to a pressure of 1,250 psig (8,720 kPa) and a hydrogen flow rate of 2.40 SCFH (0.067 $m^3/hr$) was established. The gas mix flow rate had been 1 SCFH (0.028 $m^3/hr$). The hydrocarbon feed was introduced into the system at a rate of 32 cc/hr. The temperature was slowly increased to a level that would provide 77 wt.% conversion.

Data obtained from Test No. 10 are presented in Table X hereinafter.

TABLE X

Data Obtained From Test No. 10

| Test No. | Days on Stream | Temp., °F. | Temp., °C. | WHSV | Hydrogen, SCFB | Hydrogen, $m^3/m^3$ | Relative Activity |
|---|---|---|---|---|---|---|---|
| 10 | 4 | 687 | 364 | 1.35 | 11,900 | 2,120 | 166 |
| | 5 | 691 | 1.37 | 12,200 | 2,170 | 172 | |
| | 7 | 691 | 366 | 1.38 | 12,100 | 2,150 | 173 |

Corrected Product Data*

| Test No. | Days on Stream | Conversion Wt. % | Yields, Wt. % Dry Gas | $C_4$'s | $C_5$'s |
|---|---|---|---|---|---|
| 10 | 4 | 69.2 | 3.3 | 10.2 | 10.7 |
| | 5 | 79.1 | 3.0 | 9.2 | 10.2 |
| | 7 | 77.9 | 3.1 | 9.6 | 10.3 |

| Test No. | Days On Stream | Light Naphtha | Heavy Naphtha |
|---|---|---|---|
| 10 | 4 | 15.2 | 63.6 |
| | 5 | 15.6 | 65.0 |
| | 7 | 15.5 | 64.4 |

Corrected Product Data*

| Tets No. | Days on Stream | 1-$C_4$ n-$C_4$ | 1-$C_5$ n-$C_5$ |
|---|---|---|---|
| 10 | 4 | 1.45 | 4.21 |
| | 5 | 1.43 | 3.77 |
| | 7 | 1.46 | 3.94 |

*Data corrected to WHSV = 1.42 and 77 wt.% conversion.

The data obtained for Catalyst G in Test No. 10 can be compared conveniently to the results obtained with Catalyst A and Catalyst B in Tests Nos. 1 and 2 presented hereinabove in Table II. Catalyst G, which contains nickel and molybdenum as hydrogenating metals, provides a relative activity and a heavy naphtha yield which are quite similar to those furnished by Catalyst B, which contains nickel and tungsten as hydrogenation metals. It provides an activity and a heavy naphtha yield which are superior to those provided by the hydrocracking catalyst containing cobalt and molybdenum as hydrogenating metals, i.e., Catalyst A.

In view of this, a catalyst containing nickel and molybdenum as the hydrogenating metals could be used as an alternate first catalyst in the dual-catalyst system of the present invention.

The results obtained from the tests described hereinabove indicate that a catalyst system that is employed in the process of the present invention, whether the first catalyst contains nickel and molybdenum as the hydrogenating metals or whether it contains nickel and tungsten as the hydrogenating metals, provides an improved naphtha yield and an improved activity. In addition, the catalyst system of the process of the present invention provides an improved naphtha yield, whether the second catalyst in the system, that is, the catalyst containing cobalt and molybdenum as hydrogenating metals, is a fresh catalyst or a regenerated catalyst.

What is claimed is:

1. A process for the hydrocracking of a hydrocarbon stream boiling above a temperature of about 300° F. (149° C.) and containing a substantial amount of organic nitrogen-containing compounds, which process comprises: contacting said stream in a first reaction zone under hydrocracking conditions and in the presence of hydrogen with a first catalyst comprising a hydrogenation component comprising nickel and molybdenum or nickel and tungsten and a co-catalytic acidic cracking support comprising an ultrastable, large-pore crystalline aluminosilicate material suspended in and distributed throughout a matrix of silica-alumina to provide a first hydrocracked effluent, said hydrogenation component of said first catalyst being present in the elemental form, as oxides, as sulfides, or mixtures thereof; contacting said first hydrocracked effluent in a second reaction zone under hydrocracking conditions and in the presence of hydrogen with a second catalyst comprising a hydrogenation component comprising cobalt and molybdenum and a co-catalytic acidic cracking support comprising an ultrastable, large-pore crystalline aluminosilicate material suspended in and distributed throughout a matrix of silica-alumina to provide a second hydrocracked effluent, said hydrogenation component of said second catalyst being present in the elemental form, as oxides, as sulfides, or mixtures thereof; and recovering useful products from said second hydrocracked effluent.

2. The process of claim 1, wherein the hydrogenation component of said first catalyst comprises nickel and tungsten.

3. The process of claim 1, wherein said first catalyst makes up about 10 wt.% to about 50 wt.% of the total catalyst employed in said process.

4. The process of claim 1, wherein said stream is a light virgin gas oil, a heavy virgin gas oil, a light catalytic cycle oil, a heavy catalytic cycle oil, a light vacuum gas oil, or mixtures thereof.

5. The process of claim 1, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

6. The process of claim 1, wherein said second catalyst is a catalyst that has been deactivated and then regenerated prior to its use in said process.

7. The process of claim 2, wherein the hydrogenation component of each of said catalysts comprises about 1 wt.% to about 10 wt.% Group VIII metal, based upon the weight of the catalyst and calculated as the oxide of the metal, and about 4 wt.% to about 25 wt.% Group VIB metal, based upon the weight of the catalyst and calculated as the trioxide of the metal.

8. The process of claim 2, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

9. The process of claim 2, wherein said first catalyst makes up about 10 wt.% to about 50 wt.% of the total catalyst employed in said process.

10. The process of claim 3, wherein said first catalyst makes up 15 wt.% to about 35 wt.% of the total catalyst that is employed in said process.

11. The process of claim 3, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

12. The process of claim 4, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

13. The process of claim 6, wherein the hydrogenation component of said first catalyst comprises nickel and tungsten.

14. The process of claim 6, wherein said first catalyst makes up about 10 wt.% to about 50 wt.% of the total catalyst employed in said process.

15. The process of claim 6, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

16. The process of claim 6, wherein said stream is a light virgin gas oil, a heavy virgin gas oil, a light catalytic cycle oil, a heavy catalytic cycle oil, a light vacuum gas oil, or mixture thereof.

17. The process of claim 7, wherein said first catalyst makes up about 10 wt.% to about 50 wt.% of the total catalyst employed in said process.

18. The process of claim 7, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

19. The process of claim 9, wherein said first catalyst makes up about 15 wt.% to about 35 wt.% of the total catalyst that is employed in said process.

20. The process of claim 9, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

21. The process of claim 10, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

22. The process of claim 13, wherein the hydrogenation component of each of said catalysts comprises about 1 wt.% to about 10 wt.% Group VIII metal, based upon the weight of the catalyst and calculated as the oxide of the metal, and about 4 wt.% to about 25 wt.% Group VIB metal, based upon the weight of the catalyst and calculated as the trioxide of the metal.

23. The process of claim 13, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$) and a LHSV of about 0.5 volume of hydrocarbon per hour per volume of catalyst to about 5 volumes of hydrocarbon per hour per volume of catalyst.

24. The process of claim 13, wherein said first catalyst makes up about 10 wt.% to about 50 wt.% of the total catalyst employed in said process.

25. The process of claim 14, wherein said first catalyst makes up about 15 wt.% to about 35 wt.% of the total catalyst that is employed in said process.

26. The process of claim 14, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

27. The process of claim 17, wherein said first catalyst makes up about 15 wt.% to about 35 wt.% of the total catalyst that is employed in said process.

28. The process of claim 17, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

29. The process of claim 19, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

30. The process of claim 21, wherein said stream is a light virgin gas oil, a heavy virgin gas oil, a light catalytic cycle oil, a heavy catalytic cycle oil, a light vacuum gas oil, or mixtures thereof.

31. The process of claim 22, wherein said first catalyst makes up about 10 wt.% to about 50 wt.% of the total catalyst employed in said process.

32. The process of claim 22, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

33. The process of claim 24, wherein said first catalyst makes up about 15 wt.% to about 35 wt.% of the total catalyst that is employed in said process.

34. The process of claim 24, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

35. The process of claim 25, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about20,000 SCFB (3,560 $m^3/m^3$), and a LHSV of about 0.5 volume of hydrocarbon per hour per volume of catalyst to about 5 volumes of hydrocarbon per hour per volume of catalyst.

36. The process of claim 27, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

37. The process of claim 29, wherein said stream is a light virgin gas oil, a heavy virgin gas oil, a light catalytic cycle oil, a heavy catalytic cycle oil, a light vacuum gas oil, or mixtures thereof.

38. The process of claim 31, wherein said first catalyst makes up about 15 wt.% to about 35 wt.% of the total catalyst that is employed in said process.

39. The process of claim 31, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

40. The process of claim 33, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

41. The process of claim 35, wherein said stream is a light virgin gas oil, a heavy virgin gas oil, a light catalytic cycle oil, a heavy catalytic cycle oil, a light vacuum gas oil, or mixtures thereof.

42. The process of claim 36, wherein said stream is a light virgin gas oil, a heavy virgin gas oil, a light catalytic cycle oil, a heavy catalytic cycle oil, a light vacuum gas oil, or mixtures thereof.

43. The process of claim 38, wherein said hydrocracking conditions for either zone comprise an average catalyst bed temperature of about 550° F. (288° C.) to about 850° F. (454° C.), a total hydrocracking pressure of about 5 psig (134 kPa) to about 3,000 psig (20,790 kPa), a hydrogen-to-hydrocarbon ratio of about 5,000 SCFB (890 $m^3/m^3$) to about 20,000 SCFB (3,560 $m^3/m^3$), and a LHSV of about 0.5 volume of hydrocarbon per hour per volume of catalyst to about 5 volumes of hydrocarbon per hour per volume of catalyst.

44. The process of claim 40, wherein said stream is a light virgin gas oil, a heavy virgin gas oil, a light catalytic cycle oil, a heavy catalytic cycle oil, a light vacuum gas oil, or mixtures thereof.

45. The process of claim 43, wherein said stream is a light virgin gas oil, a heavy virgin gas oil, a light catalytic cycle oil, a heavy catalytic cycle oil, a light vacuum gas oil, or mixtures thereof.

* * * * *

UNITED STATES PATENT OFFICE

CERTIFICATE OF CORRECTION

Patent No. 4,211,634 Dated July 8, 1980

Inventor(s) Ralph J. Bertolacini and Albert P. Yu

It is certified that error appears in the above-identified patent and that said Letters Patent are hereby corrected as shown below:

Abstract, line 9, "alumino-silicate" should be -- aluminosilicate --.
Column 1, line 43, "catalyt" should be -- catalyst --.
Column 4, line 48, "pre-heated" should be -- preheated --.
Column 5, line 10, "about, 550°" should be -- about 550° --.
Column 7, lines 60-61, "largepore" should be -- large-pore --.
Column 8, line 34, "aluminosilicatematrix" should be -- aluminosilicate-matrix --.
Column 9, line 32, "cocatalytic" should be -- co-catalytic --.
Column 11, line 19, "alumino-silicate" should be -- aluminosilicate --.
Column 11, lines 28-29, "alumino-silicate" should be -- aluminosilicate --.

Column 13, line 60, " $A = 100a - \frac{\Delta E}{R}\left[\frac{1}{T_o} - \frac{1}{T}\right]$ " should be -- $A = 100a - \frac{\Delta E}{R}\left[\frac{1}{T_o} - \frac{1}{T}\right]$ --.

Column 13, line 65, "gram-miole" should be -- gram-mole --.
Column 14, lines 53-54, " CORRECTION COEFFICIENT i-$C_4$ n-$C_4$ i-$C_5$ n-$C_5$ " should be -- CORRECTION COEFFICIENT $\frac{\text{i-}C_4}{\text{n-}C_4}$ $\frac{\text{i-}C_5}{\text{n-}C_5}$ --.

Column 17, lines 33-34, "(260°F.)" should be -- (260°C.) --.
Column 18, line 28, "68.4" should be -- 64.8 --.
Column 19, lines 42-45, "C4", "C5", "C6", and "C7" should be -- $C_4$ --, -- $C_5$ --, -- $C_6$ --, and -- $C_7$ --, respectively --.
Column 19, line 50, "VOL %" should be -- VOL. % --.
Column 20, line 6, "VOL %" should be -- VOL. % --.

UNITED STATES PATENT OFFICE
CERTIFICATE OF CORRECTION

Patent No. 4,211,634 Dated July 8, 1980

Inventor(s) Ralph J. Bertolacini and Albert P. Yu

It is certified that error appears in the above-identified patent and that said Letters Patent are hereby corrected as shown below:

Column 21, line 5, "Size" should be -- Size, --.
Column 21, line 6, "A" should be -- Å --.
Column 21, line 18, "CoO" should be -- CoO, --.
Column 21, line 63, "Conversion" should be -- Conversion, --.
Column 22, line 44, "MoO3" should be -- $MoO_3$ --.
Column 23, line 6, "Hydrogen," should be -- Hydrogen, --.
Column 23, line 8, "691 1.37" should be -- 691 366 1.37 --.
Column 23, line 24, "Tets" should be -- Test --.
Column 23, line 24, "1-$C_4$ 1-$C_5$ n-$C_4$ n-$C_5$" should be -- i-$C_4$ i-$C_5$ n-$C_4$ n-$C_5$ --.
Column 27, line 32, "about20,000" should be -- about 20,000 --.

Signed and Sealed this

Twenty-first Day of September 1982

[SEAL]

Attest:

GERALD J. MOSSINGHOFF

Attesting Officer

Commissioner of Patents and Trademarks